United States Patent [19]

Stewart

[11] Patent Number: 4,788,909

[45] Date of Patent: Dec. 6, 1988

[54] PAPER TOWEL DISPENSING AND SOILED TOWEL STOWING EQUIPMENT

[76] Inventor: Kelso Stewart, 69 Shandon Park, Belfast, Ireland, BT5 6NZ

[21] Appl. No.: 884,209

[22] Filed: Jul. 9, 1986

[30] Foreign Application Priority Data

Jul. 10, 1985 [GB] United Kingdom ..... 8517494

[51] Int. Cl.[4] ..... B30B 1/04

[52] U.S. Cl. ..... 100/102; 100/233; 100/295; 221/102; 221/135; 232/43.3

[58] Field of Search ..... 100/233, 266, 264, 244, 100/268, 257, 102, 295; 221/34, 102, 135; 232/43.1, 43.3; 141/73

[56] References Cited

U.S. PATENT DOCUMENTS

| | | | |
|---|---|---|---|
| 2,478,815 | 8/1949 | Forman | 100/102 |
| 2,665,632 | 1/1954 | Kawa | 100/233 |
| 3,285,505 | 11/1966 | Katz | 100/215 |
| 3,753,506 | 8/1973 | Palmer et al. | 100/244 X |
| 4,398,456 | 8/1983 | Prater | 100/244 X |
| 4,519,308 | 5/1985 | Eberle | 100/102 |

*Primary Examiner*—Timothy F. Simone

*Attorney, Agent, or Firm*—Mason, Fenwick & Lawrence

[57] ABSTRACT

Paper towel dispensing and soiled towel stowing equipment includes a receptacle (24) for used towels, a dispenser containing a supply of paper towels and tamping means (44) for compressing used towel material in the receptacle (24). The tamping means 44 is biased into an uppermost position where it urges towel engaging means (47) into engagement with the paper towels. The towel engaging means (47) disengages the towels when the tamping means is depressed by means of a pedal (42) to compress the contents of the receptacle (24). Thus, the availability of the towel material is restricted unless the user depresses the pedal (42) to compress the soiled towels.

19 Claims, 6 Drawing Sheets

18
27
20
12
50
28
44
47
53
49'
26
25
36'
24
14

18
27
20
12
28
47
53
49'
69
66
68
25'
26
36''
24
73
70
72
14

PAPER TOWEL DISPENSING AND SOILED TOWEL STOWING EQUIPMENT

BACKGROUND OF THE INVENTION

This invention relates to paper towel dispensing and soiled towel stowing equipment.

Paper towel dispensers are nowadays in widespread use in washrooms and the like. However, a problem incident to the use of such paper towel dispensers, especially in public places, is that receptacles for soiled paper towels are filled to capacity very quickly as the soiled paper towels are crumpled and disposed of into the receptacles. Such crumpled paper towels occupy an undue amount of space when heaped up with the result that the receptacles overflow and soiled paper towels are scattered about to the detriment of hygenic conditions in premises where paper towel dispensers are available.

In my co-pending United Kingdom Patent Application No. 8432525 (2152360), I have described paper towel dispensing and soiled paper towel stowing equipment wherein comprising a receptacle for soiled paper towels positioned directly below the dispenser and a paper feed mechanism urging a tamping device downwardly in or towards the receptacle to compress soiled paper towels accummulated therein. The mechanism particularly described was for use with a roll of paper available externally.

SUMMARY OF THE INVENTION

Accordingly, the present invention provides paper towel dispensing and soiled paper towel material, a dispenser positioned above said receptacle and adapted to receive a supply of towel material, tamping means associated with said receptacle and movable between a first, uppermost, position and a second, lowermost, position wherein said tamping means serves to compress used towel material within said receptacle, the tamping means being biased towards said first, uppermost, position, and towel engaging means associated with said dispenser for controlling the availability of the towel material in response to movement of said tamping means.

Preferably, said towel engaging means is movable between a first position, wherein it engages said towel material and a second position wherein said towel material is disengaged.

Preferably also, said towel engaging means is biased towards said second position but is maintained in said first position by the tamping means when said tamping means is in its uppermost position.

Preferably also, said towel engaging means is adapted, when in said first position, to maintain a portion of said towel material into a position wherein it is easily accessible to the user thereof.

Preferably also, said towel material comprises a stack of discrete, folded towels, each having a depending folded portion, said towel engaging means being adapted to engage the folded portion of the lowermost towel and urge said folded portion into an easily accessible position when said tamping means is moved from its second, lowermost, to its first, uppermost, position.

Alternatively, said towel engaging means, when in its said first position, impinges upon the towel material thereby preventing it from being withdrawn from the dispenser until the towel engaging means are disengaged by moving the tamping means into its second, lowermost, position in which case said towel material preferably comprises a roll of paper.

Preferably also, in this case said towel material comprises first and second centre-pull rolls of paper towel material stacked one on top of the other above and to the rear of the receptacle, and said towel engaging means, when in its first position, impinges upon said towel material so as to trap said material against a topmost horizontal surface.

Preferably also, said tamping means is moved from its first, uppermost, to its second, lowermost, position by depressing a pedal which is operably coupled thereto.

DESCRIPTION OF THE PREFERRED EMBODIMENTS

Figure 1:
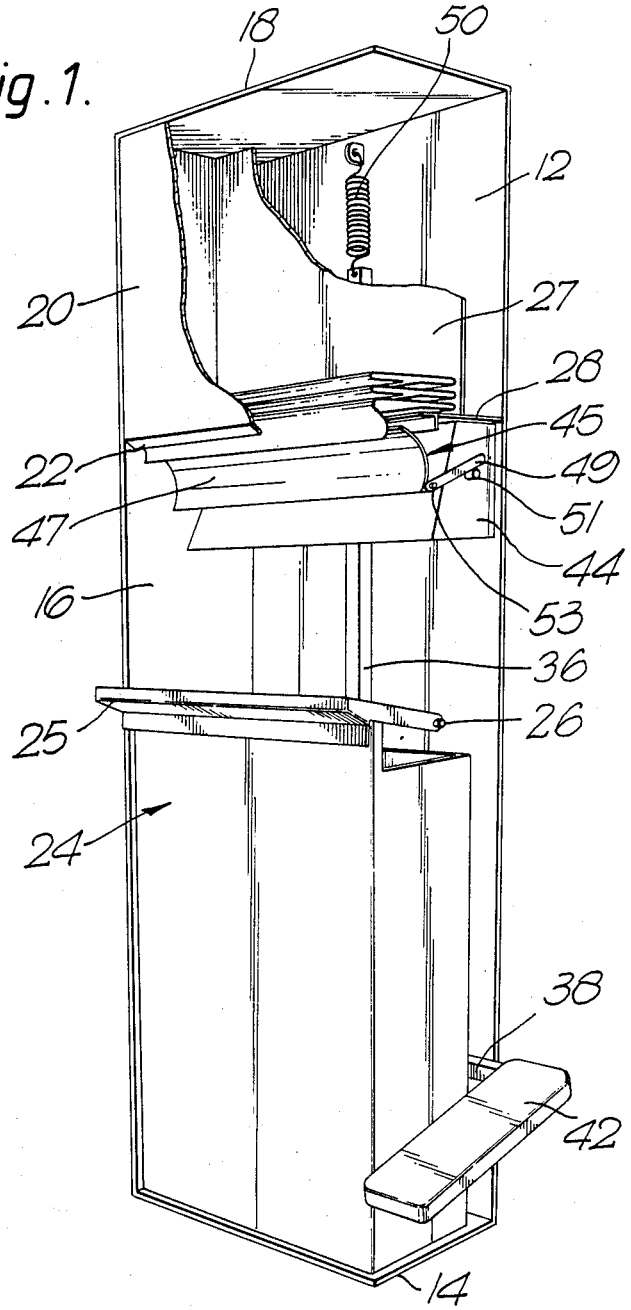
FIG. 1 is a perspective view from the front and one side of a paper towel dispensing and soiled towel stowing equipment according to the present invention.

Referring to the drawings, paper towel dispensing and soiled paper stowing equipment is shown as a cabinet with a back wall 12, a bottom wall 14, two side walls 16 and a removable top wall 18. The back wall 12 is adapted to be secured to a wall and the other walls secured to the back wall. A front wall 20 extends across the top of the open front of the cabinet 10 and has a bottom lip 22 cranked rearwardly as shown. The top portion of the cabinet 10 houses the paper towels and the bottom portion of the cabinet is occupied by a soiled towel stowing receptacle, namely a container 24, in one form a basket as shown, held in position in the cabinet 10 by a retaining clip 25 fast with a bar 26 pivoted at each end to a corresponding side wall 16. In its lower position, the clip 25 abuts and holds the top of the container 24 in place and in its raised position it is located above the pivot to enable the container 24 to be removed from the cabinet for emptying and then replacing. A plastic liner may be placed in the container if desired and the clip 25 serves to hold this in position.

A tray support 28 is provided for receiving a stack of folded paper towels as shown. The support 28 is the bottom of a housing for the stack formed by the front wall 20 and parts of the side walls 16 between said front wall 20 and a back partition 27 and said support 28. The support 28 extends the full breadth of the cabinet 10 and extends forwardly to stop short of and form with the front wall lip 22 a slot through which a depending folded portion of the lowermost paper towel extends. The top wall 18 is removable to enable fresh stacks of paper towels to be inserted.

A paper feed mechanism as shown in FIG. 1 comprises an upright shank 36 having at its bottom end a laterally extending arm 38 secured to the outer end thereof to extend through a slot (not shown) in one of the side walls 16 as shown and carrying on the outside of the side wall a foot pedal 42. The upper end of the shank 36 mounts a transversely extending tamping device 44. The shank 36 is biased upwardly by spring 50. A member 45 comprises an arcuate plate 47 extending breadth-wise a dimension similar to the breadth of a towel and two arms 49 each connected to said plate 47 at lateral edges of the rearward side of said plate 47 to extend rearward thereof to flank the sides of the tamping device 44 and be engaged by stub pins 51. The member 45 is pivoted between its extents in side elevation by a pivot pin 53 being fast with the rearward side of said plate 47 as shown, the outer ends being pivotally carried by the side walls 16. The front edge of the plate 47 engages behind the depending folded position to urge same forwardly on a return stroke of the shank 36 as shown in full line in the drawings. The member 45 is gravitationally biased in that the weight of arms 49 causes the member to pivot into a position as shown in broken line in FIGS. 2A, 2B and 2C of the drawings.

In use, a user pulls a towel out, uses it and crumples it then disposes of it into the container 24. The next user to obtain a towel pushes the shank 36 downwards by depressing the foot pedal 42 to cause the tamping device to move downwards in a tamping movement. This causes the member 45 to be released and to pivot downwardly under gravity so that the front edge of plate 47 is located behind the depending folded portion of the next towel. On release of the foot pedal, the shank 36 moves upwardly causing the pins 51 of the tamping device 44 to engage the rear end of arms 49 and swing them upwardly to cause plate 47 to push forwardly the depending folded portion of the towel into a position ready for the user to manually remove it.

Figure 2A:
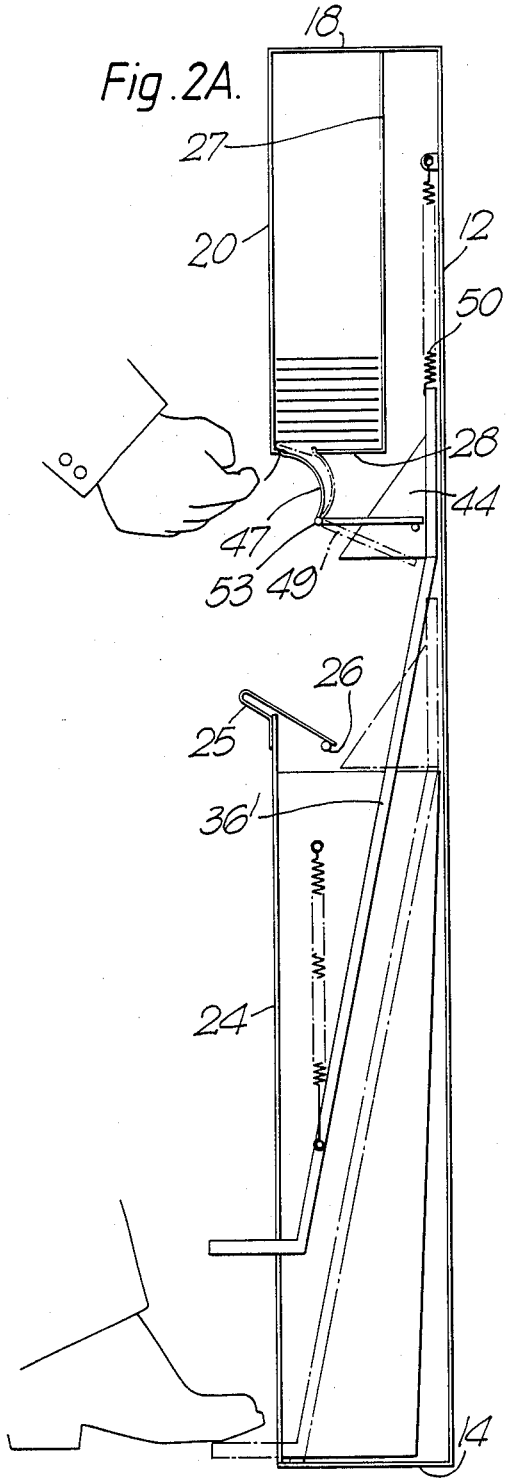
FIG. 2A, 2B and 2C are respectively side views with the nearer side removed to reveal the interior and showing three different forms of paper feed mechanism.
Figure 2B:
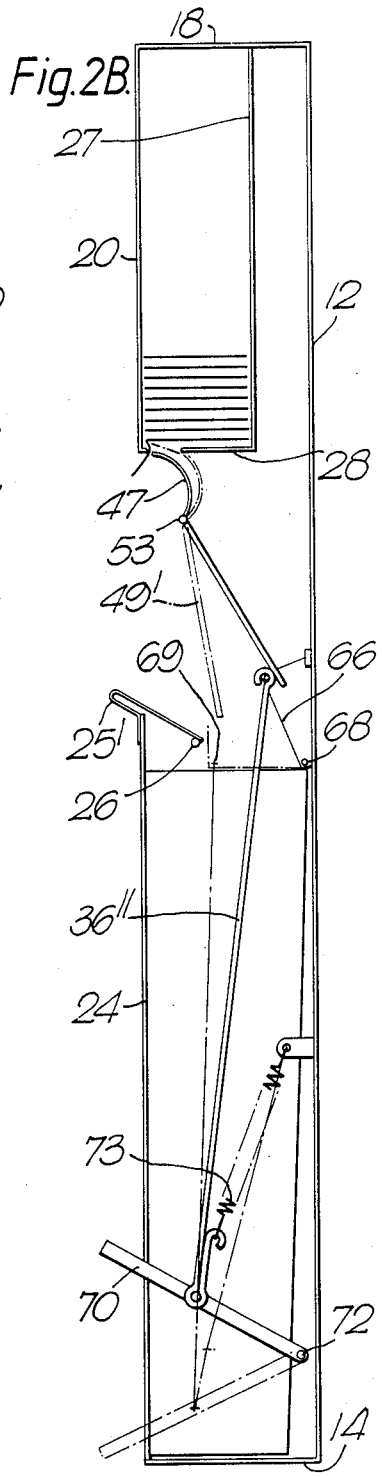
Figure 2C:
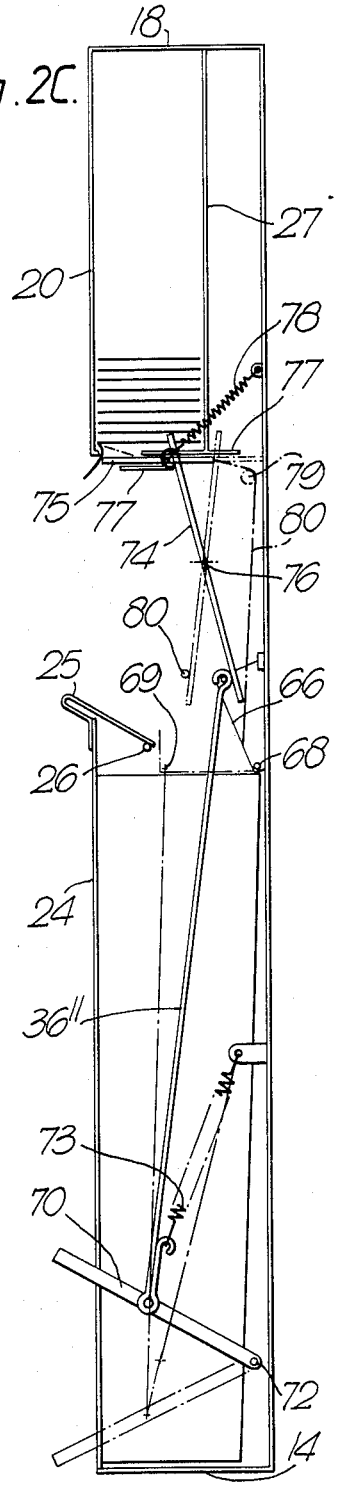

In FIGS. 2A, 2B and 2C, modified paper feed mechanisms are shown. In FIGS. 2A, the mechanism comprises two shanks 36', both cranked below the tamping device 44, and located laterally of each lateral side of container 24 and the biasing being provided by springs 60, 62 on each side. The foot pedal 64 extends out of the open front of the cabinet between the container side walls and cabinet walls and is formed by a U-member whose web extends across in front of the container, with its limbs secured to corresponding lower ends of shanks 36'.

In both FIGS. 2B and 2C, tamping device is an angled plate 66 pivoted at its rear end 68 as shown and the lateral shanks 36'' are pivotally anchored to opposite ends of rod 69 fast therewith at the corner thereof. The shanks 36'' are pivotally connected to a U-shaped foot pedal intermediate the length of limbs 70 which are pivoted at 72 to the side walls as shown. Spring 73 biases the foot pedal upwardly as shown. In FIG. 2B, the length of arm 49' is greater than previously described, the arms 49' being engaged on a return stroke by the ends of rod 69. In FIG. 2C, the member 45 is constituted by two arms 74 pivoted at 76 as shown and whose extents of movement are governed by spring 78 and stop 80. The top of arms 74 are pivoted to a plate 75 which slide horizontally between two vertically spaced plates 77 forming a modified tray support. The plate 75 can be connected if necessary by a cord 80 or the like from its pivot connection with the arms 74 around a pulley or like 79 to the plate 66 as shown.

The tamping device moves down on each depression of the shank 36 to compact soiled paper towelling in said container 24 when the crumpled paper towels reach a height at which the device comes into contact with them.

In a further modification, the container 24 may be tapered downwardly and inwardly at the back thereof to allow the cabinet to be cut-away to plush fit over a skirting board.

The front wall 20 may be translucent for ease in seeing the quantity of towels in the stack and the foot pedal 42 can be replaced by a push button actuated electric motor (not shown).

Figure 4:
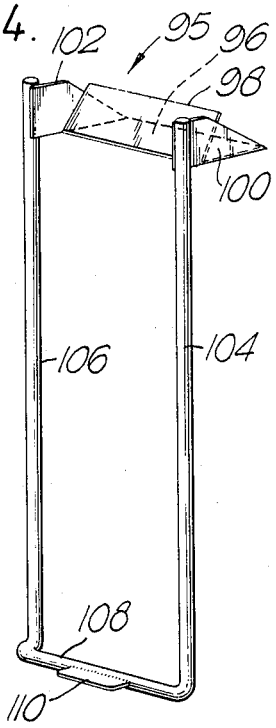
FIGS. 4 and 5 are detail views of parts of the embodiment of FIG. 3.
Figure 5:
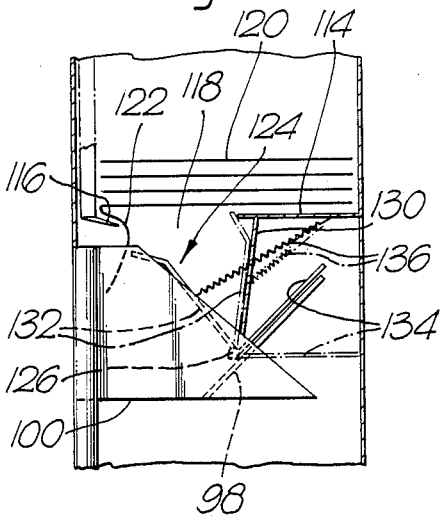
Figure 3:
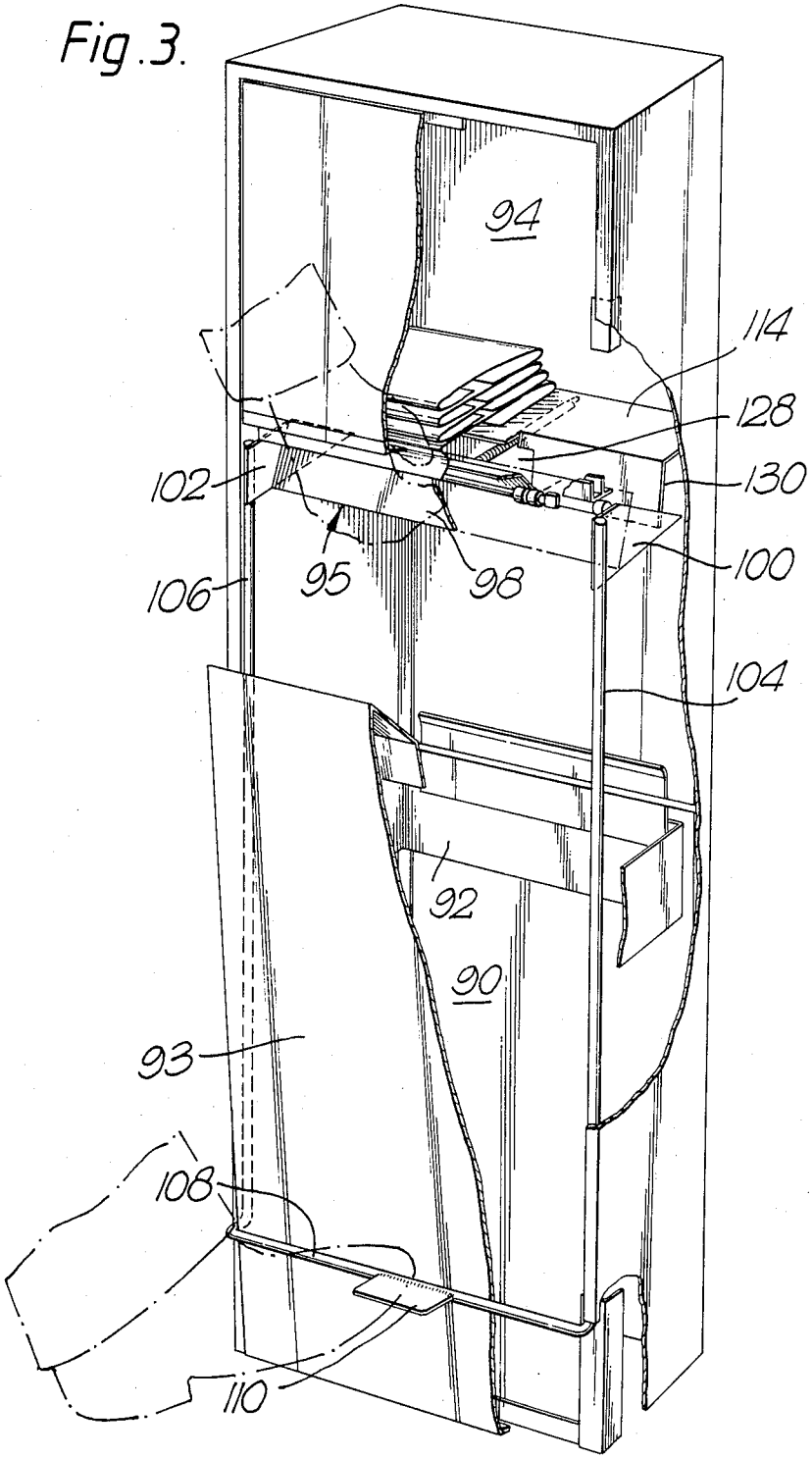
FIG. 3 is a perspective view of a further embodiment of the invention.

Referring now to FIGS. 3, 4 and 5, a further embodiment of the invention again includes a receptacle portion 90, which may comprise a bag holder 92, having a front panel 93, rather than the basket 24 of the previous embodiments, for stowing soiled towels, and a dispenser portion 94 located above said receptacle as before. In this case the tamping device 95 comprises a horizontal compression plate 96 and an inclined panel 98 mounted between two parallel side plates 100 and 102. A pair of parallel, downwardly extending shanks 104 and 106 depend from the forward edges of the side plates 100 and 102. In use, the shanks 104 and 106 are disposed towards the front of the lower ends by a transverse member 108 which extends across the front exterior of the front panel 93 and has a pedal 110 attached thereto.

As before, the tamping device 95 is movable between a first, uppermost, position (as illustrated) and a second, lowermost, position wherein the compression plate 96 may engage soiled towel material in the receptacle 92, and is biased towards said first position by any suitable bias means such as springs (not shown) which extend upwardly from the side plates 100 and 102 and may be attached to the inside surface of the side walls of the dispenser portion 94.

The dispenser portion 94 includes a relatively broad ledge 114 and a relatively narrow ledge 116 extending across the rear and the front of the dispenser 94 respectively and having a gap 118 defined therebetween. The ledges 114 and 116 serve to support a stack of towels 120 such that the depending fold 122 of the lowermost towel may project into said gap 118.

The dispenser 94 further includes a towel engaging member 124 which is pivotally mounted (at 126) in a substantially rectangular aperture 128 formed in a downwardly extending panel 130 which depends from the rearmost ledge 114.

The member 124 includes a first towel engaging portion 132 extending substantially upwards from the pivot point 126 and a second substantially rearwardly extending portion 134 approximately perpendicular to said first portion 132. The member 124 is pivotable about the point 126 such that when the tamping device 95 is in its uppermost position, the inclined panel 98 thereof engages the second portion 134 of the member 124 such that the first portion 132 thereof is angled forward as shown (FIG. 5). When the tamping device is depresssed into its second position, the member 124 is pivoted backwards under the influence of bias means, such as a spring 136 which is attached to the back of the first portion 132 of member 124 and to the bottom surface of the ledge 114, into the position shown by broken lines in FIG. 5.

The use of this embodiment is similar to the previous examples: ie. a towel is removed, the pedal 110 is depressed—allowing the member 124 to pivot backwards —and released—causing the member 124 to pivot forwards and engage the depending fold 122 of the next towel as before. The construction of this embodiment is particularly preferred since it simplifies the manufacturing process and is more compact, since the unit need only be deep enough to accommodate the width of the towel stack 120.

Figure 6:
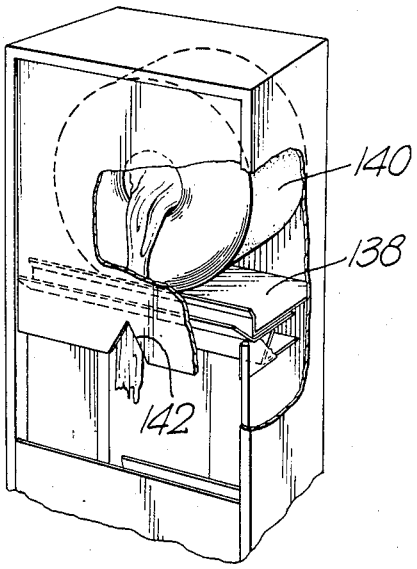
FIG. 6 is a perspective view of still another embodiment of the invention.
Figure 7:
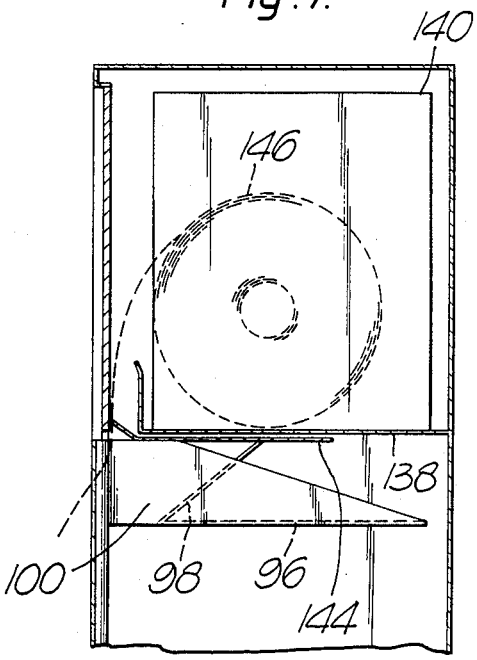
FIGS. 7 and 8 are detail views illustrating the operation of the embodiment of FIG. 6.
Figure 8:
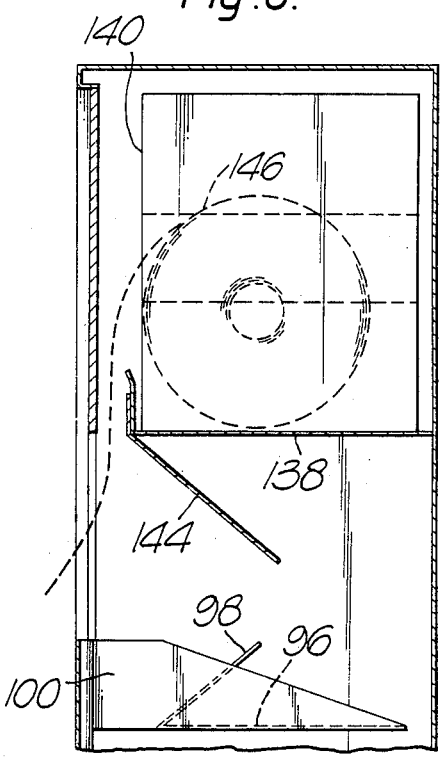

The invention is easily adaptable for use with other types of disposable towel, as is illustrated in FIGS. 6, 7 and 8, which show an adaptation for use with roll towels of the type where the towel material is pulled out from the centre of the roll. The receptacle portion and tamping device may be identical to those described in the previous examples, and the dispenser is provided with a tray 138 to support a roll of towel material 140. The material extends from the centre of the roll 140, down through a gap in front of the tray 138 and out through the front of the unit, which is provided with a notch 142 or serrated edge (not shown) to allow the required length of material to be torn off.

In this case, a towel engaging member 144 is pivotably mounted below the tray 138 and is adapted to impinge upon the material when the tamping device is in its uppermost, position (see FIG. 7), thereby preventing any more towel material being extracted from the unit, and to release the material when the tamping device is depressed (see FIG. 8). Thus, the user must depress the pedal of the unit to compresss the soiled material in the receptacle before he can obtain any towel material.

As illustrated, the roll 140 is positioned on its side with its axis horizontal, but the invention may be easily modified to have the roll on its end with its axis vertical. Similarly, a conventional roll towel 146 may be used, as is shown in broken lines in FIGS. 7 and 8, in which case the unit would be fitted with a serrated edge (not shown) extending across the width of the roll 146.

Figure 9:
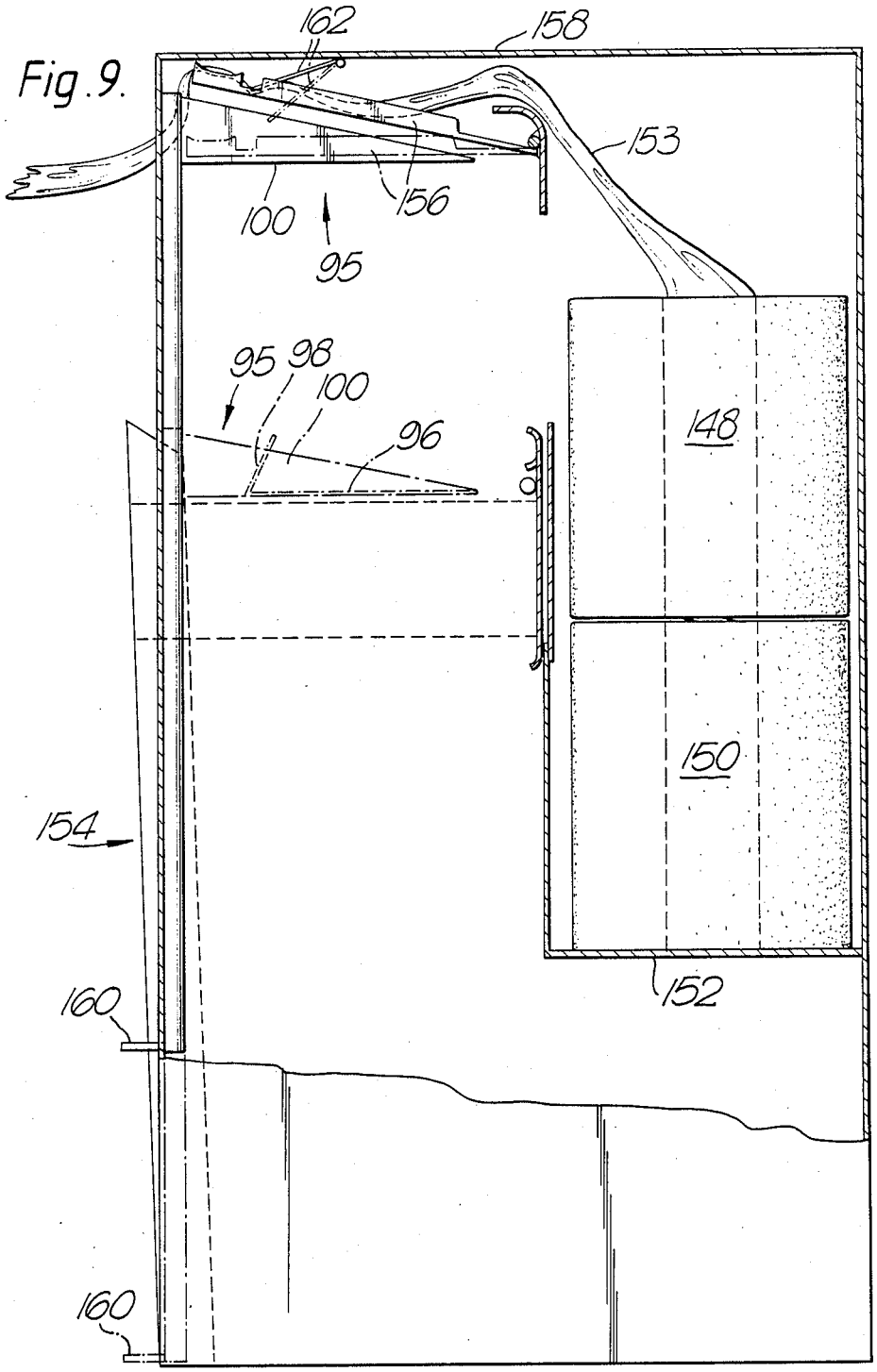
FIG. 9 is a sectional side view of still another embodiment of the invention.

FIG. 9 of the drawings shows a further, particularly preferred embodiment of the invention wherein two centre-pull towel rolls 148, 150 are stacked one on top of the other on a ledge 152 towards the rear of a combined dispenser/receptacle unit 154.

In this case, the central axes of the towel rolls 148, 150 are vertical and towel material 153 is drawn from the centre of the uppermost roll 148, forwardly and out through the front of the unit 154. In use, the material emerging from the centre of the lowermost roll 150 would be affixed to the outer end surface of the uppermost roll 148. As before, the tamping means 95 (again comprising a horizontal compression plate 96, inclined plate 98 and parallel side plates 100,102) is movable between a first, uppermost, position (shown in solid lines) and a second, lowermost, position (shown in broken lines), is biased towards said first position, and cooperates with a towel engaging member 156. The towel engaging member 156 is pivotable between a first position (shown in solid lines) wherein it is urged upwards by the tamping means 95 to impinge upon the towel material 153, which is thereby trapped against a top surface 158 of the unit 154, and a second position (shown in broken lines) wherein the material is disengaged. Again, the towel engaging member 154 is biased towards its second position (by gravity or suitably spring means) but is maintained in its first position until the pedal 160 is depressed to operate the tamping means 95.

As is also shown in FIG. 9, a secondary towel engaging member 162 may be included. As illustrated, the secondary member 162 is pivotably mounted beneath the top surface 158 and impinges upon the towel material 153, trapping it against the primary towel engaging member 156 when in its first position.

This secondary member 162 is itself pivotable between first and second positions, as shown in response to movement of the tamping means 95.

The embodiments of FIGS. 1 to 8 are relatively compact and are suitably attached to a wall. That of FIG. 9 is deeper, having a greater waste capacity created by the additional space 164 beneath the towel rolls 148, 150, and may be free-standing.

I claim:

1. Paper towel dispensing and soiled paper stowing equipment comprising a receptacle for soiled towel material, a dispenser positioned above said receptacle and adapted to receive a supply of towel material, tamping means associated with said receptacle and movable between a first, uppermost, positionand a second, lowermost, position wherein said tamping means serves to compress soiled towel material within said receptacle, the tamping means being biased towards said first, uppermost, position, and towel engaging means associated with said dispenser for controlling the availability of the towel material in response to movement of said tamping means.

2. Equipment as claimed in claim 1, wherein said towel engaging means is movable between a first position, wherein it engages said towel material and a second position, wherein said towel material is disengaged.

3. Equipment as claimed in claim 2, wherein said towel engaging means is biased towards said second position but is mantained in said first position by the tamping means when said tamping means is in its uppermost, position.

4. Equipment as claimed in claim 3, wherein said towel engaging means is adapted, when in said first position, to maintain a portion of said towel material into a position wherein it is easily accessible to the user thereof.

5. Equipment as claimed in claim 4, wherein said towel material comprises a stack of discrete, folded towels, each having a depending folded portion, said towel engaging means being adapted to engage the folded portion of the lowermost towel and urge said folded portion into an easily accessible position when said tamping means is moved from its second, lowermost, to its first, uppermost, position.

6. Equipment as claimed in claim 3, wherein said towel engaging means when in its said first position, impinges upon the towel material, thereby preventing it from being withdrawn from the dispenser until the towel engaging means is disengaged by moving the tamping means into its second, lowermost, position.

7. Equipment as claimed in claim 1, wherein said towel material comprises at least one roll of paper.

8. Equipment as claimed in claim 7, wherein said towel material comprises first and second centre-pull rolls of paper towel material stacked one on top of the other above and to the rear of the receptacle.

9. Equipment as claimed in claim 8, wherein said towel engaging means, when in its first position, impinges upon said towel material so as to trap said material against a top most horizontal surface.

10. Equipment as claimed in claim 1, wherein said tamping means is moved from its first, uppermost, to its second, lowermost, position by depressing a pedal which is operably coupled thereto.

11. Paper towel dispensing and soiled paper stowing equipment comprising a receptacle for soiled towel material, a dispenser positioned above said receptacle and adapted to receive a supply towel material, tamping means associated with said receptacle and moveable between a first, uppermost, position and a second, lowermost, position wherein said tamping means serves to compress soiled towel material within said receptacle, the tamping means being biased towards said first, uppermost, position, and towel engaging means associated with said dispenser for controlling the availability of the towel material in response to movement of said tamping means, wherein said towel engaging means is biased towards a second position but is maintained towards a first position by said tamping means when said tamping means is in its uppermost position.

12. Equipment as claimed in claim 11, wherein said towel engaging means is movable between a first position, wherein it engages said towel material and a second position, wherein said towel material is disengaged.

13. Equipment as claimed in claim 11, wherein said towel engaging means is adapted, when in said first position, to maintain a portion of said towel material into a position wherein it is easily accessible to the user thereof.

14. Equipment as claimed in claim 13, wherein said towel material comprises a stack of discrete, folded towels, each having a depending folded portion, said towel engaging means being adapted to engage the folded portion of the lowermost towel and urge said folded portion into an easily accessible position when said tamping means is moved from its second, lowermost, to it first, uppermost, position.

15. Equipment as claimed in claim 11, wherein said towel engaging means when in its said first position, impinges upon the towel material, thereby preventing it from being withdrawn from the dispenser until the towel engaging means is disengaged by moving the tamping means into its second, lowermost, position.

16. Equipment as claimed in claim 11 wherein said towel material comprises at least one roll of paper.

17. Equipment as claimed in claim 16 wherein said towel material comprises first and second centre-pull rolls of paper towel material stacked one on top of the other above and to the rear of the receptacle.

18. Equipment as claimed in claim 17, wherein said towel engaging means, when in its first position, impinges upon said towel material so as to trap said material against a top most horizontal surface.

19. Equipment as claimed in claim 11, wherein said tamping means is moved from its first, uppermost, to its second, lowermost, position by depressing a pedal which is operably coupled thereto.

* * * * *